United States Patent [19]

Hargassner et al.

[11] 4,245,692

[45] Jan. 20, 1981

[54] CONTINUOUS CASTING MOULD SUITABLE FOR ADJUSTMENT TO VARIOUS CROSS SECTIONAL FORMATS OF A STRAND

[75] Inventors: Reinhard Hargassner; Günter Holleis, both of Linz, Austria

[73] Assignee: Voest-Alpine Aktiengesellschaft, Linz, Austria

[21] Appl. No.: 46,502

[22] Filed: Jun. 7, 1979

[30] Foreign Application Priority Data

Jun. 14, 1978 [AT] Austria ..... 4328/78

[51] Int. Cl.[3] ..... B22D 11/04

[52] U.S. Cl. ..... 164/436; 164/418

[58] Field of Search ..... 164/82, 436, 418

[56] References Cited

U.S. PATENT DOCUMENTS

| | | | |
|---|---|---|---|
| 3,292,216 | 12/1966 | Colombo | 164/436 |
| 3,760,867 | 9/1973 | Murakami et al. | 164/436 |
| 3,838,730 | 10/1974 | Nagaoka et al. | 164/436 |
| 3,926,244 | 12/1975 | Meier et al. | 164/82 X |
| 4,010,793 | 3/1977 | Takemura et al. | 164/436 X |
| 4,085,793 | 4/1978 | Scheinecker et al. | 164/436 |
| 4,086,951 | 5/1978 | Takahasi et al. | 164/436 X |
| 4,134,441 | 1/1979 | Ohmori et al. | 164/82 X |

FOREIGN PATENT DOCUMENTS

| | | | |
|---|---|---|---|
| 297287 | 4/1917 | Fed. Rep. of Germany . | |
| 2018962 | 11/1971 | Fed. Rep. of Germany . | |
| 2500395 | 7/1975 | Fed. Rep. of Germany . | |
| 47-32178 | 8/1972 | Japan | 164/418 |
| 51-14825 | 2/1976 | Japan | 164/436 |
| 1240143 | 7/1971 | United Kingdom | 164/418 |

*Primary Examiner*—Robert D. Baldwin

*Attorney, Agent, or Firm*—Brumbaugh, Graves, Donohue & Raymond

[57] ABSTRACT

A continuous casting mould suitable for adjustment to various strand cross sectional formats, has at least one transversely divided side wall whose parts are displaceable and fixable relative to the opposite side wall by adjustment drives and are articulately connected with one another, the axis(es) of the connecting member(s) extending in the horizontal direction over the width of the side wall; a method of changing the cross sectional format of a strand.

2 Claims, 21 Drawing Figures

CONTINUOUS CASTING MOULD SUITABLE FOR ADJUSTMENT TO VARIOUS CROSS SECTIONAL FORMATS OF A STRAND

The invention relates to a continuous casting mould suitable for adjustment to various strand cross sectional formats comprising at least one transversely divided side wall whose parts are displaceable and fixable relative to the opposite side wall by means of adjustment drives, as well as a method of changing the cross sectional format of a strand when continously casting strands.

For changing the cross sectional format of a strand, such as e.g. for changing the strand width of a slab, the continuous casting process hitherto has had to be terminated. It was only after displacing the mould narrow sides to the new cross sectional format of the strand, that the casting process could be started anew on using a starter bar, after having carried out the necessary set-up works. This resulted first in a loss of production due to the time expenditure necessary for setting up the plant, and secondly in a deterioration of the yield due to the resulting end and starting scrap and due to the resulting residual steel in the distributor vessel.

From German Offenlegungsschrift No. 2,018,962, a specially designed mould is known with which changing of the format of a strand is feasible without using a starter bar. For this purpose, the mould comprises mould side walls that are horizontally subdivided at half-height, each of the mould side wall parts being displaceable in the horizontal direction. For changing the format, at first the bath level in the mould is lowered to below the divisional plane of the mould side walls, then the upper wall parts of the divided side walls are each laterally parallelly displaced in accordance with the new cross sectional format of the strand, whereupon a specially manufactured cooling scrap container containing cooling scrap is inserted, the bath level is raised and finally the lower wall part of the divided mould narrow-side wall is laterally parallely displaced in accordance with the upper wall part.

The change of format according to German Offenlegungsschrift No. 2,018,962 has the disadvantage that the parts of each mould side wall can be horizontally displaced only by a range that is smaller than the thickness of the copper plates mounted at those side wall parts and directed to the interior of the mould. With great format changes, several displacement steps with a plurality of cooling scrap containers are therefore necessary, what results in a correspondingly long scrap piece of the strand, besides the loss of time accruing accordingly. With the copper plates worn, the displacement steps can be carried out only by a slighter measure than with new copper plates, the number of necessary displacement steps thus increasing further. A further disadvantage of this known mould is to be seen in that frictional forces occur at the horizontal slide faces of the mould side wall parts facing each other, between the strand skin and these parts, which forces act contrary to the direction of displacement of the side wall parts. Due to a shrinkage of the strand during adjustment, the displacement of these side wall parts may be impeded or blocked by these frictional forces, displacing of the side wall parts, together or individually, having become difficult or impossible, and casting possibly having to be terminated.

The invention aims at avoiding these disadvantages and difficulties and has as its object to provide a continuous casting mould of the initially defined kind which is suitable for adjustment to various cross sectional formats of the strand and with which, in a single displacement step, the cross sectional format of a strand can be changed by any measure and with which movement of the side wall parts is not impeded by frictional forces caused by the strand.

These objects are achieved according to the invention in that the parts of the displaceable side wall are articulately connected with each other, the axis(es) of the connecting member(s) extending in the horizontal direction over the width of this side wall.

A preferred embodiment is characterized in that the divided side wall is divided into two parts, i.e. one upper part extending within the mould over approximately the total supporting length of the strand skin, and a shorter lower part liftable during casting from the strand skin into a resting position.

The invention furthermore relates to a method of changing the cross sectional format of a strand during continuous casting on using a mould according to the invention, which method is characterized in that, during an intermission in casting, at first the upper part of the two-part side wall is displaced approximately parallell to itself to a strand format to be newly adjusted, and its lower part is pivoted towards the cast strand, whereupon the mould is filled up by pouring in melt, the pivotable lower part of the side wall is pivoted away from the strand skin, and casting is continued.

Suitably, the bath level is lowered to the region of the articulate connection between the lower part and the upper part of this side wall, prior to adjustment of the upper part of the displaceable side wall.

When increasing the cross sectional format of a strand, it is advantageous, if cooling scrap is filled into the gap forming between the cast strand and the pivoted lower part of the side wall prior to filling up of the mould with melt.

The invention will now be described in more detail with reference to the accompanying drawings, wherein.

Figure 1:
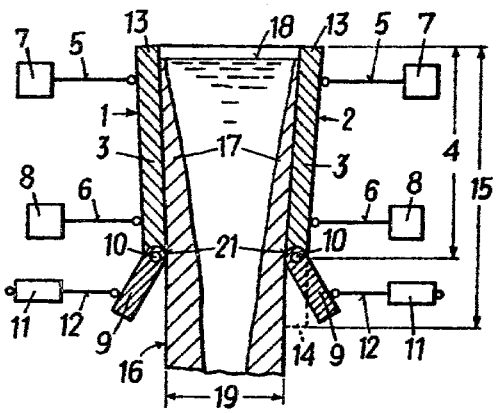
FIGS. 1 to 6 illustrate the increase in the cross sectional format of the strand.

1 and 2 denote the narrow-side walls of a slab mould, which are inserted between two broad sides, which for more clearness, are not represented in the Figures. The narrow-side walls 1, 2 are divided into two parts in the horizontal direction, one part 3, whose height extension 4 approximately corresponds to the usual extension of the height of the narrow-side wall of conventional moulds, each is articulately connected with two adjustment drives 5 and 6 each mounted in gear casings 7 and 8. The adjustment drives preferably are driven by hydromotors not illustrated, the adjustment drives 5, 6 optionally being actuatable either together or individually, so that different inclination adjustments of parts 3 of the narrow-side walls 1, 2 are feasible. A distance indicator is provided at the hydromotors, so that it may be found out at any time in what position the adjustment drives—and thus the narrow-side wall parts 3—are.

To the lower rim of these parts 3, parts 9 are hinged, the axis 10 of the connecting member between parts 3 and 9 extending in the horizontal direction over the total width of the side walls, 1, 2. Parts 9 are each pivotable about the axis 10 by means of a pressure-medium cylinder 11 specially provided therefor and whose piston rod 12 is articulately fastened to this lower part.

The broad-side walls are not illustrated for better clearness. They extend from about the upper rim 13 of parts 3 to about the lower rim 14 of parts 9, if these parts 9 are in a vertical position, as is illustrated in broken lines in FIG. 1; thus, they have approximately the height 15 indicated in FIG. 1.

The two broad-side walls lying opposite each other can be fixed in various positions relative to each other by fixing spindles, so that it is possible to clamp the narrow-side walls 1, 2 between the broad-side walls, or to provide a gap of constant size between the broad-side walls and the narrow-side walls.

The strand skin of the strand 16 being in the mould, is denoted by 17, and the bath level being in the vicinity of the upper rims 13 of the narrow-side walls 1, 2 during casting is denoted by 18.

Figure 2:
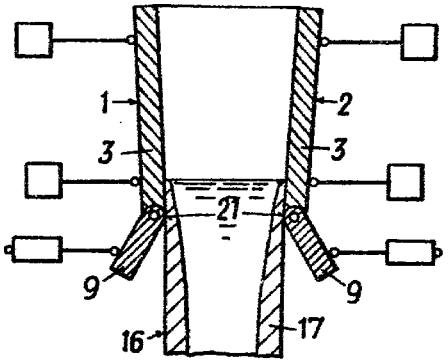
Figure 5:
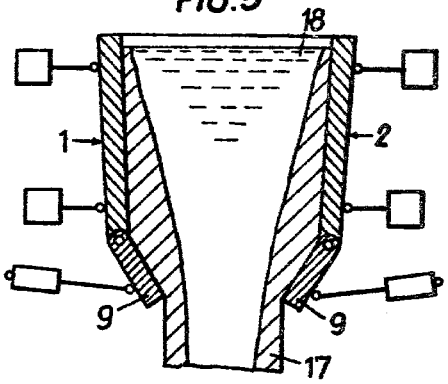

For increasing the slab width, it is proceeded in the following way:

The initial width is denoted by 19 in FIG. 1. This width is to be adjusted to the new slab width denoted by 20. For this purpose, an intermission in casting is at first provided and the bath level in the mould is lowered by lowering the strand to closely above the lower rims 21 of the narrow-side wall parts 3, as is illustrated in FIG. 2.

Figure 3:
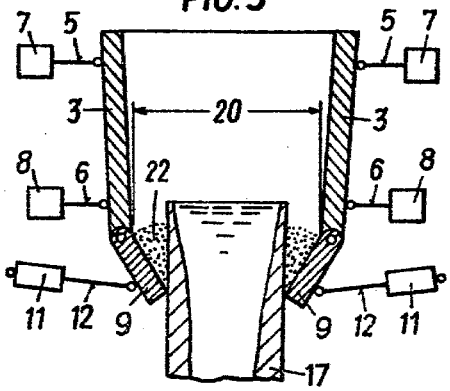

Subsequently, displacement of the narrow-side wall parts 3 to the slab width to be newly adjusted takes place by actuation of the adjustment drives 5 and 6, the inclination of these narrow-side wall parts 3 being simultaneously adjusted according to the new slab width 20. At the same time, the lower narrow-side wall parts 9 are pivoted towards the strand skin 17 by actuating the pressure-medium cylinders 11, until these parts contact the strand skin. If desired, cooling scrap 22 is introduced into the mould cavity afterwards, as is illustrated in FIG. 3.

Figure 4:
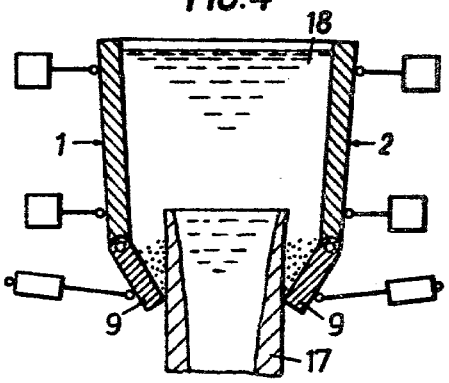
Figure 6:
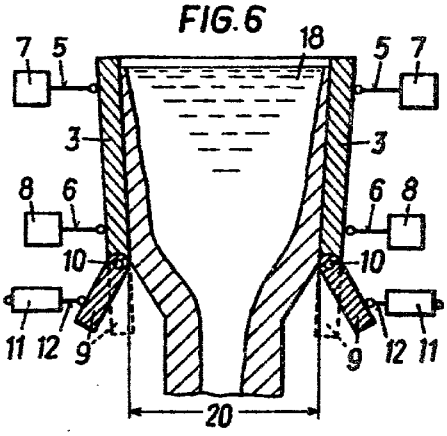
Figure 7:
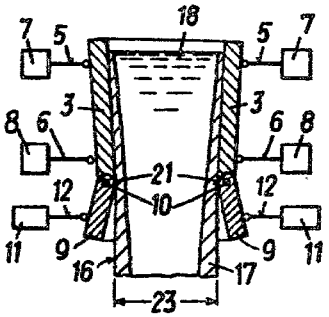
FIGS. 7 to 15 illustrate the reduction of the cross sectional format of the strand.

Thereafter, the mould cavity is filled with steel melt (FIG. 4), whereupon—after a certain period of time which is necessary for a sufficiently strong strand skin to form—the lower parts 9 of the narrow-side walls 1, 2 are again pivoted back into the initial position (according to FIG. 1), as is illustrated in FIG. 6. Observance of the period of time for the formation of a sufficiently strong strand skin is not absolutely necessary; it is also possible to pour the steel melt into the mould so slowly that a sufficiently strong strand skin will form already during the casting process.

Then, continuous casting of the strand with the new slab width 20 can be started.

It is possible to effect pivoting back of the lower parts 9 of the narrow-side walls 1, 2 by drawing off the strand, the pressure-medium cylinders being maintained without pressure, thus being moved by the strand itself. The lower parts 9 of the narrow-side walls 1, 2 need not be pivoted back, as is illustrated in FIG. 6 by full lines, but they may also be positioned in an elongation of the upper parts 3 of the narrow-side walls 1, 2, as is illustrated in FIG. 6 by broken lines, whereby cooling of the strand can be intensified.

Figure 8:
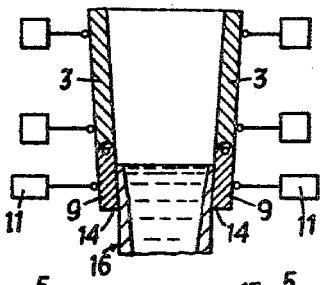
Figure 9:
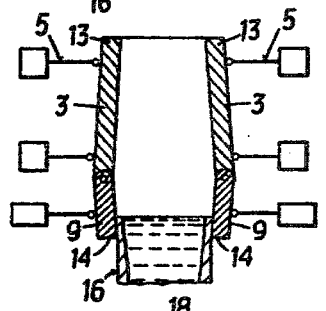
Figure 10:
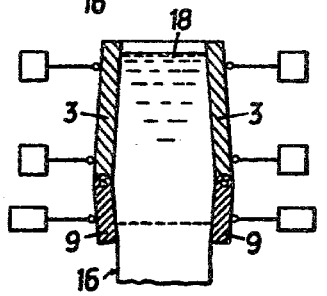
Figure 11:
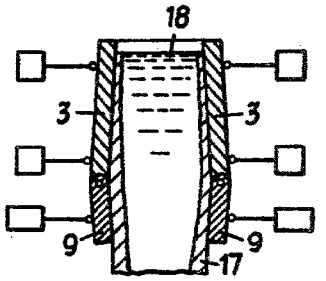
Figure 12:
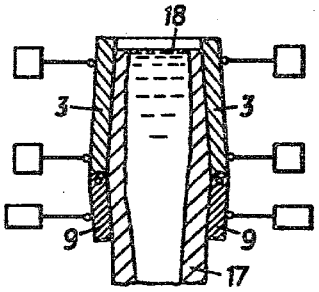

With reference to FIGS. 7 to 15, a method of reducing the slab width denoted by 23 to a new slab width 24 is explained in the following:

At first, after an intermission in casting, the bath level in the mould is lowered to the region of the lower parts 9 of the narrow-side walls 1, 2 by drawing out the strand (FIG. 8). Thereupon, the upper narrow-side wall parts 3 with their upper rims 13 are adjusted to the slab width to be newly cast, by actuation of the adjustment drives 5, and the lower parts 9 of the narrow-side walls are pivoted towards the strand skin until these parts 3 with their lower rims 14 will contact the strand skin from outside (FIG. 9). After having subsequently introduced cooling scrap if desired, the mould cavity is filled with melt until the bath level has again reached the initial height of FIG. 7, as this is shown in FIG. 10. In FIGS. 11 and 12, it is illustrated how the strand skin thickens during the following resting phase, in which the strand is not moved. This resting phase is chosen for so long a period that the strand skin contacting the narrow-side wall parts 3 and 9 has become self-bearing, i.e. sufficiently resistant against bulging caused by the ferrostatic pressure.

Figure 13:
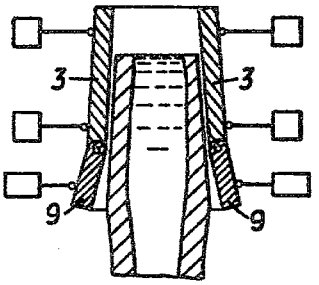
Figure 14:
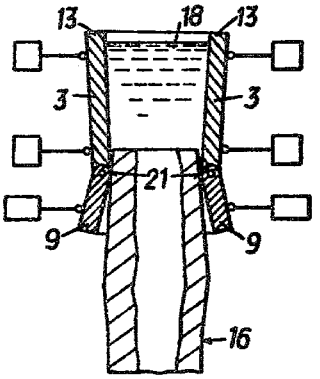
Figure 15:
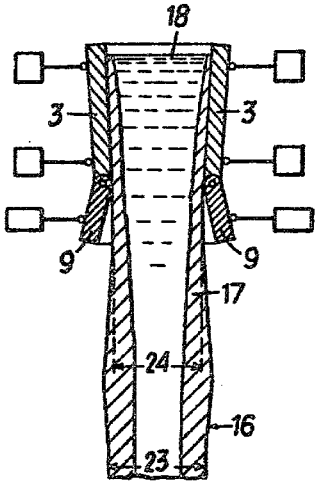
Figure 16:
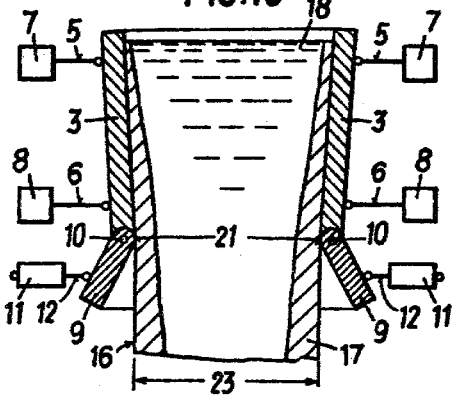
FIGS. 16 to 21 also show the procedure during the reduction of the cross sectional format of the strand, but in another manner.
Figure 19:
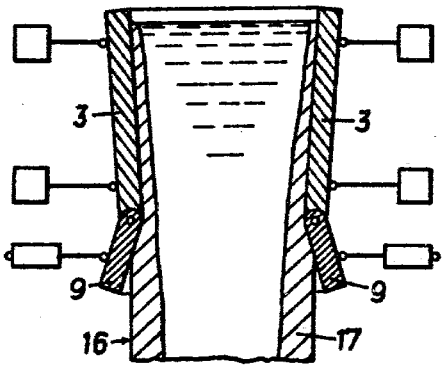
Figure 17:
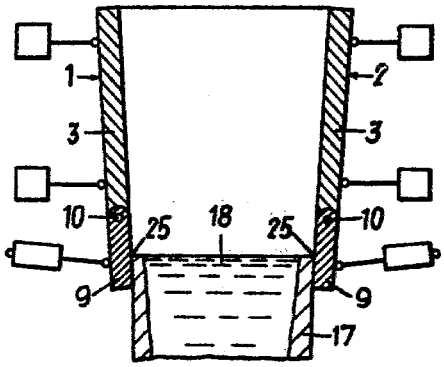

Then, as is illustrated in FIG. 13, the lower parts 9 of the narrow-side walls are pivoted away from the strand skin. Thereupon, the strand is lowered until the bath level will lie closely above the lower rims 21 of the narrow-side wall parts 3. Then, the narrow-side wall parts, with their lower rims, are moved towards the strand skin, whereupon—possibly after previously having introduced cooling scrap—the mould cavity is filled with melt until the bath level again comes to lie in the region of the upper rims 13 of the narrow-side wall parts 3. This is illustrated in FIG. 14. Thereafter, casting can be resumed on a full scale (FIG. 15).

A further possibility of proceeding when reducing the slab width to the new measure 24 is illustrated in FIGS. 16 to 21:

At first, after an intermission in casting, the bath level is lowered to the axis 10 connecting the narrow-side wall parts, whereupon the upper parts 3 of the narrow-side walls are adjusted to the slab width 24 to be newly adjusted, taking into consideration the conicity to be newly adjusted (FIG, 18). The lower parts 9 of the narrow-side walls 1, 2 in this case are arranged in a manner that the upper outer rim 25 of the strand skin sealingly contacts those parts. Thereby, this upper outer rim 25 can be slightly slanted, the sealing thus being improved.

Figure 20:
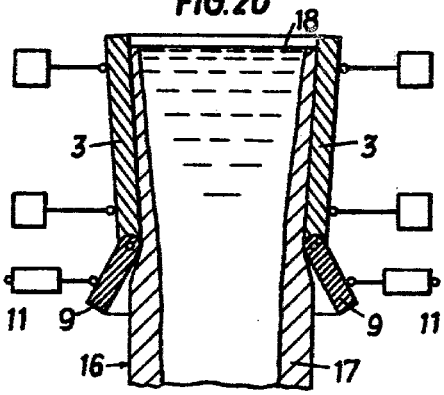
Figure 18:
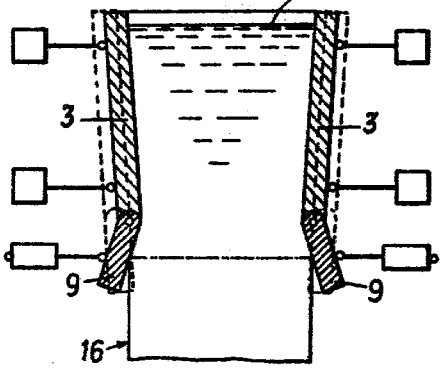
Figure 21:
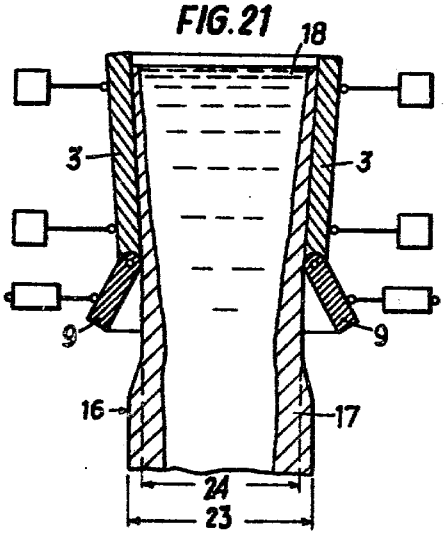

Then, as illustrated in FIG. 18, the mold is filled with melt, whereupon, after an optionally provided resting phase, as is illustrated in FIG. 20, the lower parts of the narrow-side walls are lifted off by pivoting backwards, and casting with the new slab width 24, as illustrated in FIG. 21, can be resumed.

The mould according to the invention and the methods realizable according to the invention in connection with this mould, can be applied also for changes of format at casting plants for billets or blooms. It is also possible to design only one of the narrow-side walls in two parts and to displace the same for the purpose of adjustment to various strand cross sectional formats, as described above. The side wall opposite this dividedly-designed side wall is then adjusted only to the inclination corresponding to the new slab width. The transversely divided side walls can be formed also of three parts hinged to one another.

What we claim is:

1. A continuous casting mould suitable for adjustment to various cross sectional formats of a strand, comprising at least one transversely divided displaceable side wall including at least upper and lower parts, an opposite side wall arranged oppositely said at least one transversely divided displaceable side wall, at least one adjustment drive means articulately connected to each of said upper and lower parts for laterally adjusting and fixing said upper and lower parts, respectively, relative to said opposite side wall, and connecting means articulately connecting said upper and lower parts and having at least one axis extending in the horizontal direction over the width of said at least one transversely divided displaceable side wall.

2. A continuous casting mould as set forth in claim 1, wherein said at least one transversely divided displaceable side wall divided into upper and lower parts define the upper part so as to extend, within said continuous casting mould when in operation, over the total supporting length of the strand skin, and the lower part so as to be shorter than said upper part and liftable, during casting, from the strand skin into a resting position.

* * * * *